US008188947B2

(12) United States Patent
Chung

(10) Patent No.: US 8,188,947 B2
(45) Date of Patent: May 29, 2012

(54) PIXEL AND ORGANIC LIGHT EMITTING DISPLAY DEVICE INCLUDING THE SAME

(75) Inventor: Kyung-Hoon Chung, Suwon-si (KR)

(73) Assignee: Samsung Mobile Display Co., Ltd., Yongin (KR)

( * ) Notice: Subject to any disclaimer, the term of this patent is extended or adjusted under 35 U.S.C. 154(b) by 649 days.

(21) Appl. No.: 12/365,070

(22) Filed: Feb. 3, 2009

(65) Prior Publication Data

US 2009/0243977 A1 Oct. 1, 2009

(30) Foreign Application Priority Data

Mar. 28, 2008 (KR) ..... 10-2008-0028884

(51) Int. Cl.
*G09G 3/30* (2006.01)

(52) U.S. Cl. ..... 345/82; 345/76

(58) Field of Classification Search ..... None
See application file for complete search history.

(56) References Cited

U.S. PATENT DOCUMENTS

| | | | | |
|---|---|---|---|---|
| 2007/0040770 | A1* | 2/2007 | Kim | 345/76 |
| 2008/0036704 | A1 | 2/2008 | Kim et al. | |
| 2008/0224965 | A1* | 9/2008 | Kim | 345/76 |

FOREIGN PATENT DOCUMENTS

| | | | |
|---|---|---|---|
| JP | 2003-255897 | | 9/2003 |
| JP | 2006-154066 | | 6/2006 |
| JP | 2006-154067 | | 6/2006 |
| KR | 1020050096671 | A | 10/2005 |
| KR | 10-2006-0031546 | | 4/2006 |
| KR | 10-2006-0056791 | | 5/2006 |
| KR | 10-2007-0002476 | | 1/2007 |

OTHER PUBLICATIONS

Office Action issued in Korean Patent Application No. 2009-031362875 dated Jul. 29, 2009.

* cited by examiner

*Primary Examiner* — Joseph Haley
(74) *Attorney, Agent, or Firm* — Christie, Parker & Hale, LLP

(57) ABSTRACT

An organic light emitting display device including: a plurality of pixels, each of the pixels including an organic light emitting diode (OLED) and a pixel circuit for driving the OLED, the pixel circuit including: a first transistor for transferring a data signal supplied from a data line to a current scan line; a second transistor for controlling an amount of current corresponding to the data signal that flows from a first pixel power supply to the OLED; a third transistor for diode-connecting the second diode according to the current scan signal; a storage capacitor for maintaining a gate voltage of the second transistor in accordance with the data signal; and a fourth transistor for initializing a first node according to a previous scan signal supplied before the current scan signal is supplied, the fourth transistor in a pixel region of a previous row pixel.

13 Claims, 6 Drawing Sheets

PIXEL AND ORGANIC LIGHT EMITTING DISPLAY DEVICE INCLUDING THE SAME

CROSS-REFERENCE TO RELATED APPLICATIONS

This application claims priority to and the benefit of Korean Patent Application No. 10-2008-0028884, filed on Mar. 28, 2008, in the Korean Intellectual Property Office, the entire content of which is incorporated herein by reference.

BACKGROUND OF THE INVENTION

1. Field of the Invention

The present invention relates to a pixel and an organic light emitting display device including the same.

2. Description of Related Art

Recently, various flat panel display devices having light weight and small volume, as compared to cathode ray tubes, have been developed.

Among the flat panel display devices, organic light emitting display devices have excellent brightness and color purity by displaying images using organic light emitting diodes, which are self-emission devices. Therefore, they are in the spotlight as next generation display devices.

Such organic light emitting display devices can be categorized as passive matrix type organic light emitting display devices and active matrix type organic light emitting display devices, depending on a scheme for driving the organic light emitting diodes.

The active matrix type organic light emitting display device includes a plurality of pixels positioned at crossing points of scan lines and data lines. Each of the pixels includes an organic light emitting diode and a pixel circuit for driving it.

The active matrix type organic light emitting display device has a small power consumption so that it is useful for a portable display device, etc.

However, the active matrix type organic light emitting display device has a disadvantage in that its picture quality becomes non-uniform as a result of brightness differences between pixels generated due to threshold voltage variation of driving transistors.

Therefore, pixel circuits of a variety of structures have been suggested to compensate for the threshold voltage variation of the driving transistors. Currently, a pixel structure adopting a compensating transistor coupling the driving transistor to the diode during a predetermined period is well known.

However, in the case of compensating for the threshold voltage by coupling the driving transistor to the diode, a signal may not be normally written according to a voltage level of a data signal supplied for every frame.

For example, when the voltage level of the data signal supplied in a current frame is lower than that of the data signal supplied in a previous frame, a direction in which the driving transistor is diode-connected may be reversely set so that the data signal may not be written in the pixel.

Therefore, in order to prevent this, it is desirable to efficiently initialize each of the pixels before writing the data signal.

However, in the case of coupling a separate initialization power supply to each of the pixels for such an initialization, the number of signal lines within a display unit can increase.

Also, since the initialization is generally performed while a previous scan signal is being supplied, each of the pixels is coupled to a current scan line as well as a previous scan line.

Therefore, two scan line portions are disposed at a region in which each of the pixels is located.

Accordingly, in a conventional organic light emitting display device, an aperture ratio is reduced and there is a spatial limitation associated with pixel formation.

Also, in the conventional organic light emitting display device, portions of the two scan lines are disposed in each of the pixels so that one terminal of a scan driver should drive the two scan lines. Therefore, since a load applied to each terminal of the scan driver increases, an internal circuit of the scan driver should have sufficient capacity to be able to cope with this.

SUMMARY OF THE INVENTION

An aspects of embodiments of the present invention are directed toward an organic light emitting display device capable of efficiently initializing pixels, reducing a load applied to each terminal of a scan driver, and raising aperture ratio.

An embodiment of the present invention provides an organic light emitting display device including: a plurality of pixels positioned at crossing regions of scan lines and data lines, each of the pixels including an organic light emitting diode and a pixel circuit for driving the organic light emitting diode, the pixel circuit including: a first transistor for transferring a data signal supplied from a corresponding one of the data lines according to a current scan signal supplied to a current scan line among the scan lines; a second transistor for controlling an amount of current corresponding to the data signal that flows from a first pixel power supply to the organic light emitting diode; a third transistor for diode-connecting the second diode according to the current scan signal; a storage capacitor for maintaining a gate voltage of the second transistor in accordance with the data signal; and a fourth transistor for initializing a first node to which a gate electrode of the second transistor is coupled according to a previous scan signal supplied before the current scan signal is supplied, the fourth transistor in a pixel region of a previous row pixel among the plurality of pixels, in which a portion of a previous scan line among the scan lines is located, wherein the fourth transistor of each of the pixels in second to $n^{th}$ rows of the pixels is coupled between the organic light emitting diode of the previous row pixel and the first node of the pixel initialized by the fourth transistor.

The fourth transistor of each of the pixels positioned in the second to $n^{th}$ rows may be coupled to an anode electrode of the organic light emitting diode in the previous row pixel and a second pixel power supply through the organic light emitting diode of the previous row pixel.

The fourth transistors in each of the pixels in a first row of the pixels may be positioned at a dummy pixel region in a previous row of the first row pixels and is controlled by a portion of the $\mathbf{0}^{th}$ scan line located in the dummy pixel region.

The fourth transistor in each of the pixels in the first row may be coupled between the first node and the organic light emitting diode provided in the pixel initialized by the fourth transistor.

The fourth transistor in each of the pixels in the first row may be coupled to the second pixel power supply through the organic light emitting diode in the pixel initialized by the fourth transistor.

The fourth transistor in each of the pixels in the first row may be coupled between an initialization power supply in the dummy pixel region and the first node of the pixel initialized by the fourth transistor.

A portion of a corresponding one of the light emitting control lines for supplying a light emitting control signal may be further located in each of the pixels, and each of the pixel circuits may further include fifth and sixth transistors that electrically couple the second transistor to the first pixel power supply or the organic light emitting diode, corresponding to the light emitting control signal.

The previous scan signal and the current scan signal may be sequentially supplied, and the light emitting control signal may maintain a voltage level for turning off the fifth and sixth transistors during a period in which the previous scan signal and the current scan signal are supplied, and may then be shifted to a voltage level for turning on the fifth and sixth transistors.

The organic light emitting display device according to claim 7, wherein each of the pixels is initialized during a first period in which the previous scan signal is supplied, stores the data signal during a second period in which the current scan signal is supplied, and supplies current corresponding to the data signal to the organic light emitting diode during a third period in which the light emitting control signal is shifted to the voltage level for turning on the fifth and sixth transistors.

Another embodiment of the present invention provides a pixel including: an organic light emitting diode and a pixel circuit for driving the organic light emitting diode, the pixel circuit including: a first transistor for transferring a data signal supplied from a data line according to a current scan signal supplied to a current scan line; a second transistor for controlling an amount of current corresponding to the data signal that flows from a first pixel power supply to the organic light emitting diode; a third transistor for diode-connecting the second diode according to the current scan signal; a storage capacitor for maintaining a gate voltage of the second transistor in accordance with the data signal; and a fourth transistor for initializing a node to which a gate electrode of the second transistor is coupled according to a previous scan signal supplied from a previous scan line before the current scan signal is supplied, wherein the fourth transistor couples the pixel to the organic light emitting diode of a previous row pixel at which a portion of the previous scan line is positioned.

The fourth transistor may be positioned in an adjacent pixel region corresponding to the a previous row pixel having the portion of the previous scan line therein.

The fourth transistor may be coupled to an anode electrode of the organic light emitting diode of the previous row pixel and a second pixel power supply through the organic light emitting diode of the previous row pixel.

The pixel may further include a fifth and a sixth transistor that couple the second transistor to the first pixel power supply and the organic light emitting diode, respectively, according to a light emitting control signal supplied from a light emitting control line.

BRIEF DESCRIPTION OF THE DRAWINGS

The accompanying drawings, together with the specification, illustrate exemplary embodiments of the present invention, and together with this description, serve to explain the principles of the present invention.

DETAILED DESCRIPTION

Figure 1:
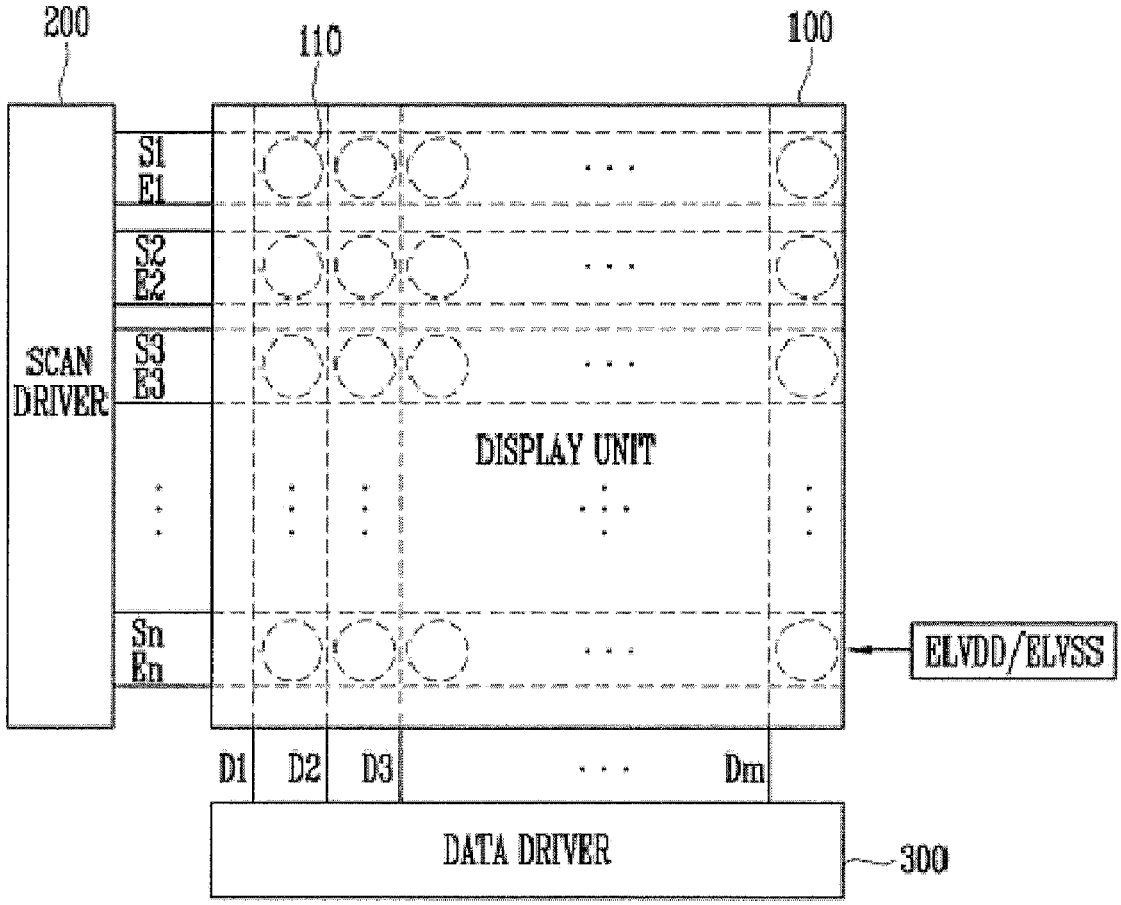
FIG. 1 is a block diagram showing an organic light emitting display device according to an embodiment of the present invention.

In the following detailed description, only certain exemplary embodiments of the present invention have been shown and described, simply by way of illustration. As those skilled in the art would realize, the described embodiments may be modified in various different ways, all without departing from the spirit or scope of the present invention. Accordingly, the drawings and description are to be regarded as illustrative in nature and not restrictive. Like reference numerals designate like elements throughout the specification. Also, when a first element is described as being coupled to a second element, the first element may be directly coupled to the second element, or may be indirectly coupled to the second element via a third element. Further, some of the elements that are not essential to the complete understanding of the invention are omitted for clarity.

FIG. 1 is a block diagram showing an organic light emitting display device according to an embodiment of the present invention.

Referring to FIG. 1, the organic light emitting display device according to the embodiment of the present invention includes a display unit 100, a scan driver 200, and a data driver 300.

The display unit 100 includes a plurality of pixels 110 positioned at crossing regions of scan lines S1 to Sn, light emitting control lines E1 to En, and data lines D1 to Dm.

Each of the pixels 110 is coupled to the scan line S arranged in a row at which it is positioned and the data line D arranged in a column at which it is positioned. These pixels 110 emit light corresponding to a scan signal, a light emitting control signal, and a data signal each supplied from the scan line S, the light emitting control lines E, and the data line D coupled thereto, respectively.

An image is displayed on the display unit 100 by light emitting from these pixels 110.

The pixel unit 100 is supplied with powers respectively from first and second power supplies ELVDD and ELVSS from the outside. The powers from these first and second power supplies ELVDD and ELVSS are transferred to each of the pixels 110 to be used as driving power for the pixels.

Also, an upper end of the display unit 100 may include dummy pixels.

The scan driver 200 sequentially generates scan signals corresponding to a scan control signal supplied from the outside. The scan signals generated in the scan driver 200 are transferred to the pixels 110 through the scan lines S1 to Sn.

The data driver 300 generates data signals corresponding to a data control signal and data supplied from the outside. The data signals generated in the data driver 300 are transferred to the pixels 110 through the data lines D1 to Dm.

Figure 2:
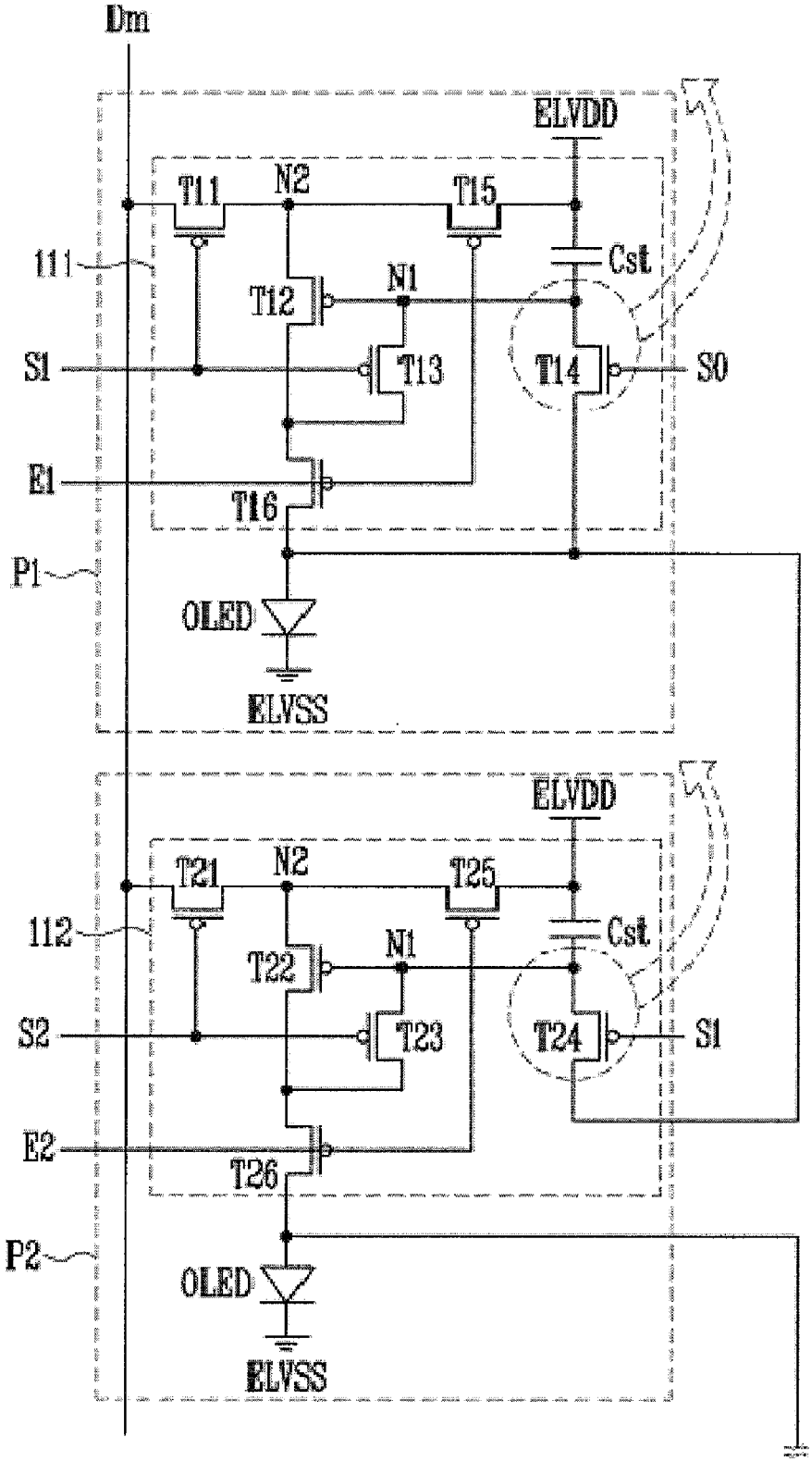
FIG. 2 is a circuit diagram showing pixels according to one embodiment of the present invention.
Figure 3:
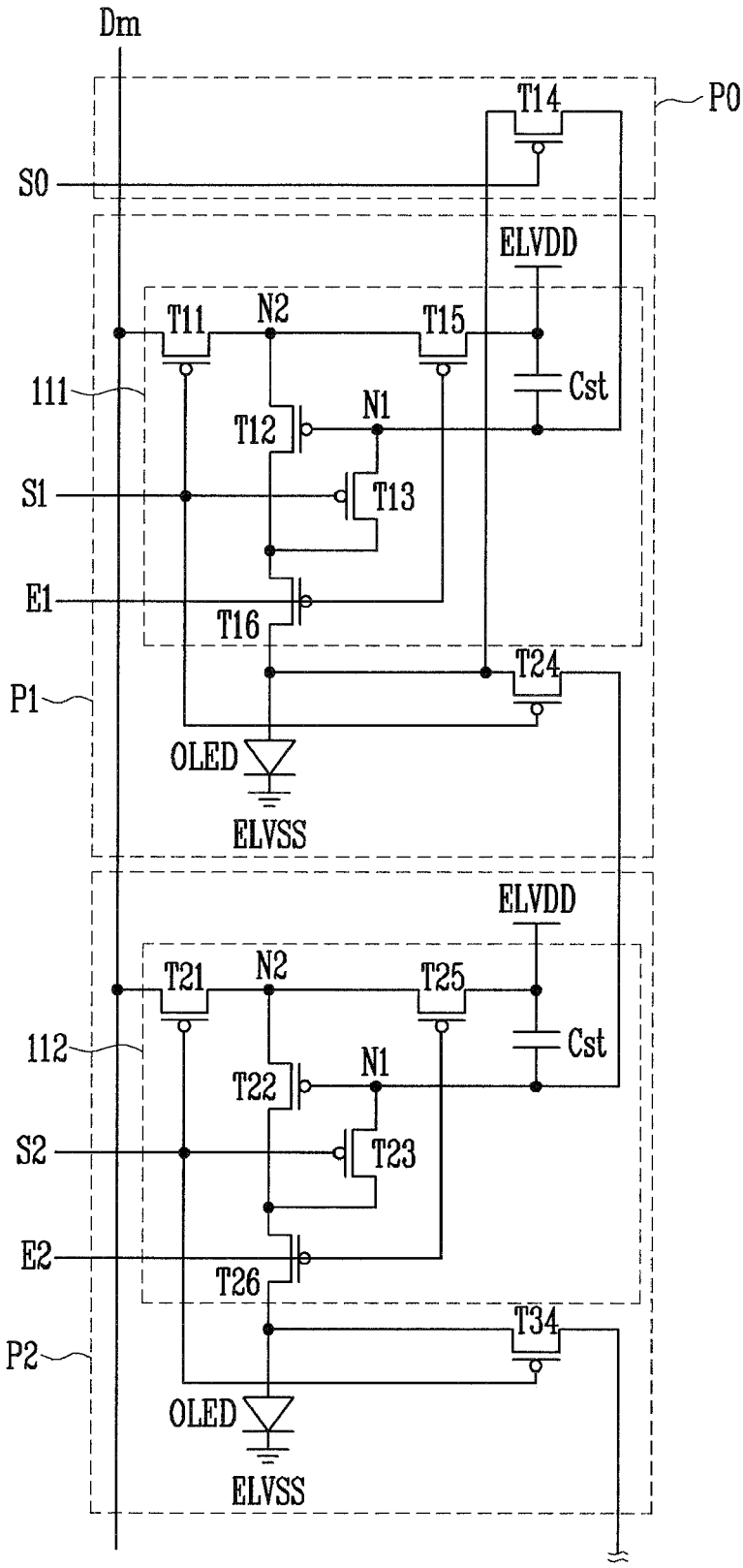
FIG. 3 is a circuit diagram indicating an actual position of a fourth transistor shown in FIG. 2.

FIG. 2 is a circuit diagram showing pixels according to one embodiment of the present invention, and FIG. 3 is a circuit diagram indicating an actual position of a fourth transistor shown in FIG. 2. For convenience, FIGS. 2 and 3 illustrate first and second pixels disposed in successive first and second rows only. These pixels may be applied to the organic light emitting display device shown in FIG. 1.

Referring to FIGS. 2 and 3, the first and second pixels P1 and P2 respectively include organic light emitting diodes OLEDs, and pixel circuits 111 and 112 for driving the organic light emitting diodes OLEDs.

Here, the first and second pixels P1 and P2 have substantially the same structure, except for fourth transistors T14 and T24 for initialization. Pixels not shown (that is, pixels arranged at third to $n^{th}$ rows) have substantially the same structure as that of the second pixel P2.

First, a configuration of the second pixel P2 disposed in the second row and driven by a second scan line S2 and a second light emitting control line E2 will be described below.

In the second pixel P2, an anode electrode of the organic light emitting diode OLED is coupled to the pixel circuit 112, and a cathode electrode of the OLED is coupled to a second pixel power supply ELVSS. The organic light emitting diode OLED emits light with a brightness (e.g., a predetermined brightness) corresponding to an amount of current supplied by the pixel circuit 112.

The pixel circuit 112 includes first to sixth transistors T21 to T26 and a storage capacitor Cst.

The first transistor T21 is coupled between a data line Dm and a second node N2, and a gate electrode of the first transistor T21 is coupled to a current scan line S2. The first transistor T21 transfers a data signal from the data line Dm to the second node N2 in response to a current scan signal supplied through the current scan line S2.

The second transistor T22 is coupled between the second node N2 and the organic light emitting diode OLED, and a gate electrode of the second transistor T22 is coupled to a first node N1. The second transistor T22 controls an amount of current flowing to the organic light emitting diode OLED, corresponding to a voltage level of the first node N1.

When the current scan signal is supplied, the data signal transferred through the data line Dm is stored in the storage capacitor Cst, so that the voltage level of the first node N1 is maintained. Therefore, the amount of current flowing through the second transistor T22 is set to a value corresponding to the data signal.

The third transistor T23 is coupled between a gate electrode and one other electrode of the second transistor T22, and a gate electrode of the third transistor T23 is coupled to the current scan line S2. When the current scan signal is supplied to the current scan line S2, the third transistor T23 is turned on to diode-connect the second transistor T22.

The fourth transistor T24 is coupled between the first node N1 and the organic light emitting diode OLED of a previous row pixel (e.g., the first pixel, P1). A gate electrode of the fourth transistor T24 is coupled to a previous scan line (e.g., a first scan line S1).

For example, the fourth transistor T24 is coupled between the first node N1 of the second pixel P2 and an anode electrode of the organic light emitting diode OLED of the first pixel P1. Accordingly, it may be coupled to a second pixel power supply ELVSS through the organic light emitting diode OLED of the previous row pixel (first pixel P1).

When the scan signal is supplied to the previous scan line S1, the fourth transistor T24 is turned on to initialize the first node N1 of the second pixel P2 to a voltage level close to that of the second pixel power supply ELVSS.

That is, when the fourth transistor T24 is turned on, the first node N1 is initialized to a voltage level higher by a threshold voltage of the organic light emitting diode OLED than the voltage level of the second pixel power supply ELVSS. Such a voltage level is a voltage suitable for initializing the first node N1, and it is possible to initialize the first node N1 using it. Thereby, a gate voltage of the second transistor T22 is initialized.

As such, in the present embodiment, one electrode of the fourth transistor T24 is coupled to the anode electrode of the organic light emitting diode OLED of the first pixel P1. Thereby, the second pixel P2 is initialized to the voltage level close to that of the second pixel power supply ELVSS during an initialization period.

The process is more convenient since a process of coupling the fourth transistor T24 to the anode electrode of the organic light emitting diode OLED is simpler than a process of coupling it to the cathode electrode of the OLED (or a supply line of the second pixel power supply ELVSS).

Also, the transistor T24 is directly coupled to the anode electrode of the OLED to prevent a problem that might occur if the transistor T24 were directly coupled to the second pixel power supply ELVSS. In other words, by coupling to the transistor T24 to the anode electrode of the OLED, the problem of reduced storage speed during a subsequent period due to reducing the voltage level of the node N1 more than necessary during the initialization period is prevented.

However, the present invention is not limited thereto, and the second pixel P2 may be initialized using the voltage of the second pixel power supply ELVSS in other embodiments.

The fifth transistor T25 is coupled between the first pixel power supply ELVDD and the second node N2, and a gate electrode of the fifth transistor T25 is coupled to a light emitting control line E2.

When a high-level light emitting control signal is supplied from the light emitting control line E2, the fifth transistor T25 is turned off to electrically disconnect (or uncouple) the first pixel power supply ELVDD from the second node N2.

When the supply of the high-level light emitting control signal is suspended, (that is, the voltage level of the light emitting control signal transitions from a high level to a low level so that a low-level light emitting control signal is supplied), the fifth transistor T25 is turned on to electrically couple the first pixel power supply ELVDD to the second node N2. Accordingly, the second transistor T22 is electrically coupled to the first pixel power supply ELVDD.

The sixth transistor T26 is coupled between the second transistor T22 and the organic light emitting diode OLED, and a gate electrode of the sixth transistor T26 is coupled to the light emitting control line E2.

When the high-level light emitting control signal is supplied from the light emitting control line E2, the sixth transistor T26 is turned off to prevent current from flowing to the organic light emitting diode OLED. That is, the sixth transistor T26 prevents the organic light emitting diode OLED from emitting light while the light emitting control signal is supplied.

The sixth transistor T26 is turned on during a period where a supply of the high-level light emitting control signal is stopped and the low-level light emitting control signal is supplied, to electrically couple the second transistor T22 to the organic light emitting diode OLED. Thereby, the current supplied by the second transistor T22 is provided to the organic light emitting diode OLED.

The storage capacitor Cst is coupled between the first pixel power supply ELVDD and the first node N1. The storage capacitor Cst is initialized by the voltage supplied to the first node N1 through the fourth transistor T24 during a period where the scan signal is supplied to the previous scan line.

The storage capacitor Cst stores the data signal supplied via the first to third transistors T21 to T23 during a period where the scan signal is supplied to the current scan line S2.

Using the storage capacitor Cst, the voltage of the first node N1 is maintained as the voltage corresponding to the data signal until a next frame starts. Therefore, the gate voltage of the second transistor T22 is constantly maintained during a light emitting period subsequent to a storing (or writing) period of the data signal, so that the organic light emitting diode OLED stably emits light.

The above-mentioned second pixel P2 is initialized through the organic light emitting diode OLED of the first pixel (i.e., a previous row pixel) P1 during a period where the previous scan signal (e.g., S1) is supplied. The second pixel P2 stores the data signal supplied to the data line Dm during the period where the current scan signal (e.g., S2) is supplied.

Thereafter, the second pixel P2 emits light at a brightness corresponding to the data signal during a subsequent light emitting period. Also, the pixels positioned in the third to $n^{th}$ rows have substantially the same structure as the second pixel P2, so that they are driven using the same scheme as the second pixel P2.

A dummy pixel P0 (shown in FIG. 3) disposed in a previous row of the first pixel P1 does not include an organic light emitting diode OLED. Accordingly, the fourth transistor T14 of the first pixel P1 is coupled between the first node N1 and the organic light emitting diode OLED (for example, the anode electrode) of the first pixel P1 itself.

That is, the first pixel P1 is initialized through the organic light emitting diode OLED of the first pixel P1 during a period where a previous scan signal is supplied to a portion of the previous scan line S0 located in the dummy pixel P0. The remaining configurations and operations of the first pixel P1 are the same as those of the second pixel P2, and therefore the detailed description thereof will be omitted.

In an embodiment of the present invention, the fourth transistors T14 and T24 for initializing the pixels P1 and P2 during the period in which respective previous scan signals are supplied are disposed in regions of the previous row pixels P0 and P1 at which portions of the respective previous scan lines S0 and S1 are arranged, respectively.

More specifically, as shown in FIG. 3, the fourth transistors T14 and T24 for respectively initializing the first and second pixels P1 and P2 are disposed in regions of the dummy pixel P0 and the first pixel P1, respectively.

The dummy pixel P0 may include with a pixel circuit (not shown) and an ITO layer constituting an anode electrode of the organic light emitting diode OLED formed in other pixels P, but does not include an organic light emitting diode OLED. That is, a light emitting layer, etc. of the organic light emitting diode OLED is formed only in the pixels P other than the dummy pixel P0.

The initialization transistor (that is, the fourth transistor T14) of the first pixel P1 may be implemented, for example, by coupling the ITO layer of the dummy pixel P0 to the ITO layer, which is the anode electrode of the organic light emitting diode OLED of the first pixel P1.

Also, since each of the gate electrodes of the fourth transistors T14 and T24 for initializing the respective pixels P1 and P2 is coupled to a respective one of the previous scan lines S0 and S1, a portion of only a corresponding one of the scan lines S1 and S2 is located in each of the pixels P1 and P2.

That is, according to an exemplary embodiment of the present invention, it is possible to locate the fourth transistors T14 and T24 for initializing the pixels P1 and P2, coupled to the respective current scan lines S1 and S2, at the respective previous row pixels P0 and P1, in which the respective portion of previous scan lines S0 and S1 are located. Thereby, it is possible to reduce the number of portions of scan lines S located within each of the pixels P1 and P2.

Accordingly, it is possible to increase an aperture ratio of the pixels P1 and P2 and to solve a spatial limitation problem caused by the configurations of the pixels P1 and P2 in conventional pixels. Also, since load applied to each terminal of the scan driver is reduced, it is possible to reduce a circuit area of the scan driver 200.

Also, according to an embodiment of the present invention, it is possible to initialize the pixels P1 and P2, positioned in the current row, during the period in which the previous scan signal is supplied, by coupling the initialization transistors T14 and T24 to the respective anode electrodes of the organic light emitting diodes OLEDs located in the respective previous row pixels P0 and P1. Thereby, it is possible to efficiently initialize the pixels P1 and P2 without having a separate initialization power supply line.

Hereinafter, a method of driving the pixels shown in FIG. 2 will be described in detail with reference to FIG. 4 and FIG. 2.

Figure 4:
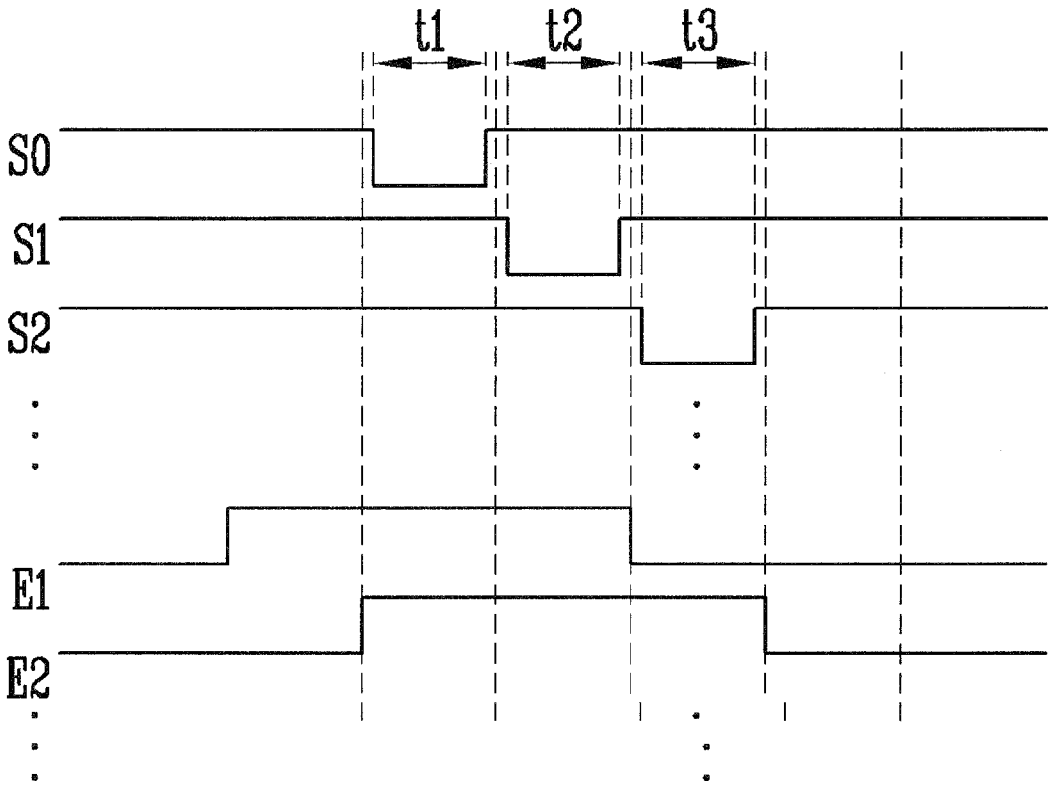
FIG. 4 is a waveform diagram for explaining a driving method of the pixels shown in FIG. 2.

Referring to FIG. 4, when a 0 scan signal is first supplied to a 0 scan line S0 with a low level during a t1 period, the fourth transistor T14 of the pixel P1 is turned on. Then, the first node N1 is initialized through the organic light emitting diode (OLED) of the pixel P1. In other words, the first node N1 is initialized during the t1 period where the 0 scan signal is supplied.

Thereafter, when a first scan signal with a low level is supplied to a first scan line S1 during a t2 period, the first and third transistors T11 and T13 are turned on in the first pixel P1, and the second transistor T12 diode connected by the third transistor T13 is turned on.

Then, the data signal supplied from the data line Dm is supplied to the first node N1 via the first to third transistors T11 to T13.

At this time, since the second transistor T12 is diode-connected, the voltage corresponding to the difference between the data signal and the threshold voltage of the second transistor T12 is supplied to the first node N1. The voltage supplied to the first node N1 is stored in the storage capacitor Cst.

Meanwhile, the fourth transistor T24 is turned on in response to the first scan signal in the second pixel P2 during the t2 period. Then, the first node N1 of the second pixel P2 is initialized through the organic light emitting diode OLED of the first pixel P1.

In other words, the data signal is stored (or written) in the first pixel P1 and the second pixel P2 is initialized, during the t2 period.

Thereafter, when the second scan signal is supplied to the second scan line S2 during a t3 period, the data signal is stored in the second pixel P2 and the third pixel P3 is initialized. The method is similar to the method during the t2 period, and the detailed description thereof will not be repeated.

The light emitting control signal with a high level is supplied to the light emitting control line E of the corresponding pixel P during the period in which the initialization period and the data signal of each pixel P are stored. After the initialization of the pixel P and the storing of the data signal are completed, the light emitting control signal supplied to the corresponding pixel P is shifted to the low level.

For example, the first light emitting control signal with a high level capable of turning off the fifth and sixth transistors T15 and T16 is supplied to the first light emitting control line E1 during the t1 and t2 periods, when the previous scan signal (that is, the 0 scan signal) and a current scan signal (that is, the first scan signal) are supplied to the first pixel P1. Therefore, current flowing to the organic light emitting diode of the first pixel P1 is prevented during the t1 and t2 periods.

The first light emitting control signal is shifted to the voltage level for turning on the fifth and sixth transistors T15 and T16 after the t1 and t2 periods are completed. Therefore, the current corresponding to the data signal flows from the first pixel power supply ELVDD to the second pixel power supply ELVSS via the fifth, second, and sixth transistors, T15, T12, and T16, and the organic light emitting diode OLED. Therefore, the organic light emitting diode OLED emits light at a brightness corresponding to the data signal.

Likewise, the second light emitting control signal, with a high level capable of turning off the fifth and sixth transistors T25 and T26, is supplied to the second light emitting control line E2 during the t2 and t3 periods, when the previous scan signal (that is, the first scan signal) and a current scan signal (that is, the second scan signal) are supplied to the second pixel P2. Thereafter, the second light emitting control signal is shifted to the voltage level capable of turning on the fifth and sixth transistors T25 and T26, and therefore, the organic light emitting diode (OLED) of the second pixel P2 emits light with a brightness corresponding to the data signal.

Figure 5:
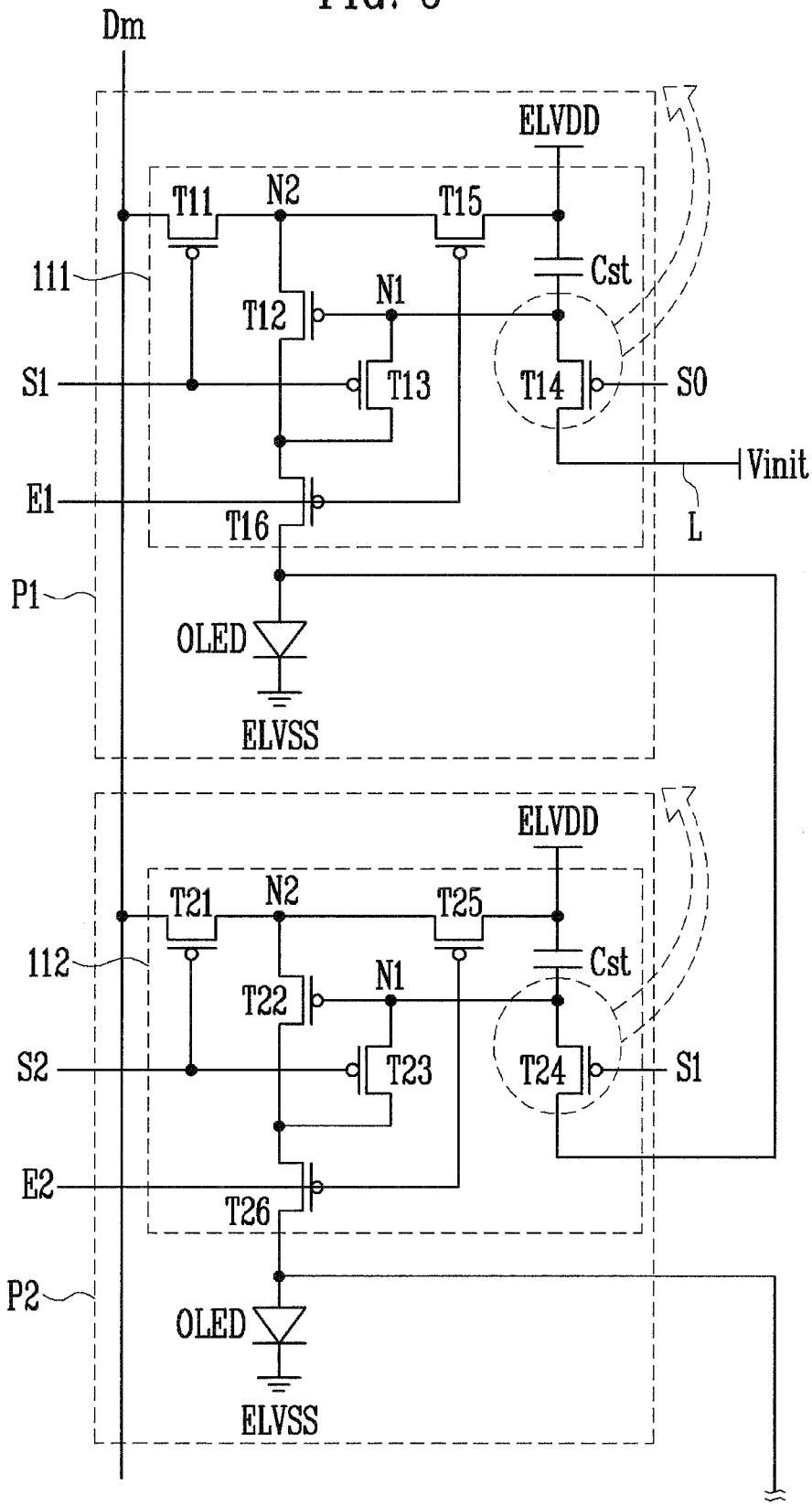
FIG. 5 is a circuit diagram showing pixels according to another embodiment of the present invention.
Figure 6:
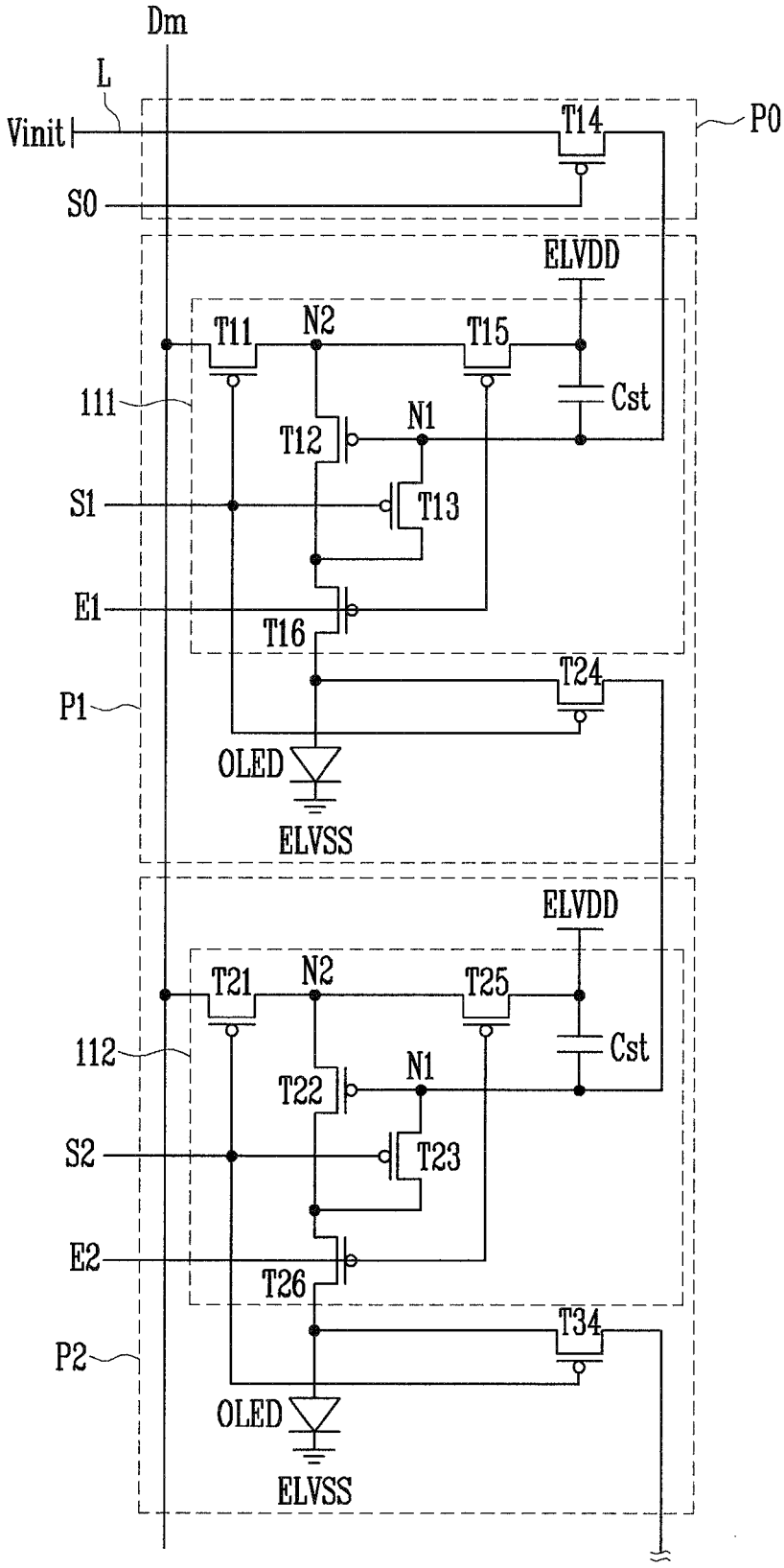
FIG. 6 is a circuit diagram indicating an actual position of a fourth transistor shown in FIG. 5.

FIG. 5 is a circuit diagram showing pixels according to another embodiment of the present invention. FIG. 6 is a circuit diagram indicating an actual position of the fourth transistors shown in FIG. 5. The portions of another embodiment shown in FIGS. 5 and 6 other than an initialization transistor (fourth transistor T14) of a first row pixel (a first pixel P1) are the same as the embodiment shown in FIGS. 2 and 3, and therefore, the detailed description thereof will not be repeated.

Referring to FIGS. 5 and 6, the fourth transistor T14 of the first pixel P1 is coupled to the initialization power supply line L disposed in the dummy pixel P0 region and the first node N1 of the first pixel P1. The gate electrode of the fourth transistor T14 is coupled to the 0 scan line S0.

In other words, one electrode and the gate electrode of the fourth transistor T14 are coupled to the initialization power supply line L and the 0 scan line S0, respectively, disposed in the dummy pixel P0 region in which one electrode and the gate electrode of the fourth transistor T14 are disposed. The other electrode of the fourth transistor T14 is coupled to the first node N1 of the first pixel P that is initialized on its own.

The fourth transistor T14 is turned on when the 0 scan signal is supplied to the 0 scan line S0 to initialize the first node N1 of the first pixel P1 at the voltage level of the initialization power supply Vinit.

In another embodiment according to the present invention, a portion of the initialization power supply line L1 for the initialization of the first pixel P1 is located in the region of the dummy pixel P0. However, separate initialization power supply lines or portions thereof are not located in the regions of the pixels P1, P2, . . . , and Pn that are light emitting pixels positioned in the first row to the n row.

Therefore, another embodiment described with reference to FIGS. 5 and 6 can obtain substantially the same effect as the embodiment shown in FIGS. 2 and 3.

While the present invention has been described in connection with certain exemplary embodiments, it is to be understood that the invention is not limited to the disclosed embodiments, but, on the contrary, is intended to cover various modifications and equivalent arrangements included within the spirit and scope of the appended claims, and equivalents thereof.

What is claimed is:

1. An organic light emitting display device comprising:

a plurality of pixels respectively positioned at pixel regions arranged into rows, each of the pixel regions being located at a crossing region of a corresponding one of scan lines and a corresponding one of data lines, each of the pixels comprising an organic light emitting diode and a pixel circuit for driving the organic light emitting diode, wherein the pixel circuit of one of the pixels positioned at a corresponding one of the pixel regions on a current row from among the rows of the pixel regions, comprises:

a first transistor for transferring a data signal supplied from the corresponding one of the data lines according to a current scan signal supplied to a current scan line from among the scan lines;

a second transistor for controlling an amount of current corresponding to the data signal that flows from a first pixel power supply to the organic light emitting diode;

a third transistor for diode-connecting the second transistor according to the current scan signal;

a storage capacitor for maintaining a gate voltage of the second transistor in accordance with the data signal; and a fourth transistor for initializing a first node to which a gate electrode of the second transistor is coupled according to a previous scan signal supplied before the current scan signal is supplied, the fourth transistor being located at the pixel region of a previous row pixel of the pixels on a previous row from among the rows of the pixel regions, in which a portion of a previous scan line from among the scan lines is located, the previous row being offset from the current row in a direction perpendicular to a direction in which the scan lines extend, wherein the fourth transistor of each of the pixels in second to $n^{th}$ rows of the pixel regions is configured to initialize the first node with a voltage at an electrode of the organic light emitting diode of the previous row pixel.

2. The organic light emitting display device according to claim 1, wherein the fourth transistor of each of the pixels positioned in the second to $n^{th}$ rows of the pixel regions is coupled to an anode electrode of the organic light emitting diode in the previous row pixel and a second pixel power supply through the organic light emitting diode of the previous row pixel.

3. The organic light emitting display device according to claim 1, wherein the fourth transistor of each of the pixels in a first row of the pixel regions is positioned at a dummy pixel region in a row previous to the first row pixel regions and is controlled by a portion of a $0^{th}$ scan line located in the dummy pixel region, from among the scan lines.

4. The organic light emitting display device according to claim 3, wherein the fourth transistor of each of the pixels in the first row of the pixel regions is coupled between the first node and the organic light emitting diode of the pixel initialized by the fourth transistor.

5. The organic light emitting display device according to claim 4, wherein the fourth transistor of each of the pixels in the first row of the pixel regions is coupled to a second pixel power supply through the organic light emitting diode of the pixel initialized by the fourth transistor.

6. The organic light emitting display device according to claim 3, wherein the fourth transistor of each of the pixels in the first row of the pixel regions is coupled between an initialization power supply in the dummy pixel region and the first node of the pixel initialized by the fourth transistor.

7. The organic light emitting display device according to claim 1, wherein a portion of a corresponding one of the light emitting control lines for supplying a light emitting control signal is further located in each of the pixels, and each of the pixel circuits further comprises fifth and sixth transistors that electrically couple the second transistor to the first pixel power supply or the organic light emitting diode, corresponding to the light emitting control signal.

8. The organic light emitting display device according to claim 7, wherein the previous scan signal and the current scan signal are sequentially supplied, and the light emitting control signal maintains a voltage level for turning off the fifth and sixth transistors during a period in which the previous scan signal and the current scan signal are supplied, and is then shifted to a voltage level for turning on the fifth and sixth transistors.

9. The organic light emitting display device according to claim 7, wherein each of the pixels is initialized during a first period in which the previous scan signal is supplied, stores the data signal during a second period in which the current scan signal is supplied, and supplies current corresponding to the data signal to the organic light emitting diode during a third period in which the light emitting control signal is shifted to a voltage level for turning on the fifth and sixth transistors.

10. A pixel located in one of a plurality of pixel regions arranged in rows and columns, the pixel comprising: an organic light emitting diode and a pixel circuit for driving the organic light emitting diode, the pixel circuit comprising:

a first transistor for transferring a data signal supplied from a data line according to a current scan signal supplied to a current scan line;

a second transistor for controlling an amount of current corresponding to the data signal that flows from a first pixel power supply to the organic light emitting diode;

a third transistor for diode-connecting the second transistor according to the current scan signal;

a storage capacitor for maintaining a gate voltage of the second transistor in accordance with the data signal; and a fourth transistor for initializing a first node to which a gate electrode of the second transistor is coupled according to a previous scan signal supplied from a previous scan line before the current scan signal is supplied, wherein the fourth transistor is configured to initialize the first node with a voltage at an electrode of an organic light emitting diode of a previous row pixel at which a portion of the previous scan line is positioned, the previous row pixel being on a previous row of the pixel regions from among the rows of the pixel regions.

11. The pixel according to claim 10, wherein the fourth transistor is positioned in an adjacent pixel region corresponding to the previous row pixel having the portion of the previous scan line therein, wherein the adjacent pixel region is offset from the pixel region corresponding to the pixel in a column direction of the pixel regions.

12. The pixel according to claim 10, wherein the fourth transistor is coupled to an anode electrode of the organic light emitting diode of the previous row pixel and a second pixel power supply through the organic light emitting diode of the previous row pixel.

13. The pixel according to claim 10, wherein the pixel further comprises a fifth and a sixth transistor that couple the second transistor to the first pixel power supply and the organic light emitting diode, respectively, according to a light emitting control signal supplied from a light emitting control line.

* * * * *